US008118711B2

(12) United States Patent
Chen

(10) Patent No.: US 8,118,711 B2
(45) Date of Patent: Feb. 21, 2012

(54) SECURITY APPARATUS FOR TREADMILL

(75) Inventor: Allen Chen, Changhua County (TW)

(73) Assignee: Michael Lin, Taipei (TW)

( * ) Notice: Subject to any disclaimer, the term of this patent is extended or adjusted under 35 U.S.C. 154(b) by 60 days.

(21) Appl. No.: 12/383,446

(22) Filed: Mar. 24, 2009

(65) Prior Publication Data

US 2010/0248898 A1 Sep. 30, 2010

(51) Int. Cl.
*A63B 24/00* (2006.01)

(52) U.S. Cl. ..... 482/4; 482/1

(58) Field of Classification Search ..... 482/1, 4, 482/54

See application file for complete search history.

(56) References Cited

U.S. PATENT DOCUMENTS

| | | | | |
|---|---|---|---|---|
| 6,638,076 | B2 * | 10/2003 | Wang | 439/39 |
| 2005/0190520 | A1 * | 9/2005 | Schomaker et al. | 361/104 |
| 2009/0054208 | A1 * | 2/2009 | Wu | 482/4 |
| 2010/0159713 | A1 * | 6/2010 | Nishihira et al. | 439/39 |

* cited by examiner

*Primary Examiner* — Loan Thanh
*Assistant Examiner* — Shila Jalalzadeh Abyane
(74) *Attorney, Agent, or Firm* — Charles E. Baxley

(57) ABSTRACT

A treadmill is provided with a security apparatus. The security apparatus includes a plug and a socket. The plug includes a casing and a conductive card. The conductive card includes a first portion disposed in the casing and a second portion extended from the casing. The socket includes a casing and two conductive elements. The casing includes a slot defined therein. The conductive elements are disposed in the casing so that the conductive elements are isolated from each other normally but connected to each other through the conductive card when the conductive card is inserted into the casing through the slot.

2 Claims, 8 Drawing Sheets

SECURITY APPARATUS FOR TREADMILL

BACKGROUND OF INVENTION

1. Field of Invention

The present invention relates to a treadmill and, more particularly, to a security apparatus for a treadmill.

2. Related Prior Art

Treadmills are often used in gymnasiums or at home. To avoid injury of a child due to careless or accidental actuation of a treadmill or injury of an adult due to falling on a treadmill, a treadmill is often equipped with a security apparatus. The security apparatus includes a first unit provided on a dashboard of the treadmill and a second unit tied to a person who intends to use the treadmill. When the second unit is in contact with the first unit, the treadmill can be actuated. Once the second unit is removed from the first unit, the treadmill is stopped.

In a plug-and-socket security apparatus, the first unit is a socket while the second unit is a plug. The socket includes a switch disposed therein. Once inserted in the socket, the plug pushes the switch so that the treadmill can be actuated. Once removed from the socket, the plug releases the switch. However, the switch would fail due to fatigue after some time of use so that the treadmill could be actuated although the plug is removed from the switch.

In a magnetic security apparatus, the first unit includes a conductive element disposed in a dashboard, two rods movably inserted through the dashboard, two elastic elements for keeping the rods extended from the dashboard and a magnetic element disposed in the dashboard. The second unit is a ferromagnetic card. Once attracted to the magnetic element, the ferromagnetic card pushes the rods into the dashboard so that the rods are in contact with the conductive element. Thus, the treadmill can be actuated. Once removed from the magnetic element, the ferromagnetic card releases the rods so that the treadmill cannot be actuated. However, due to fatigue after some time of use, the elastic elements would fail to remove the rods from the conductive element although the ferromagnetic card is removed from the magnetic element.

Therefore, the present invention is intended to obviate or at least alleviate the problems encountered in prior art.

SUMMARY OF INVENTION

It is the primary objective of the present invention to provide a treadmill with a durable and reliable security apparatus.

To achieve the foregoing objective, the security apparatus includes a plug and a socket. The plug includes a casing and a conductive card. The conductive card includes a first portion disposed in the casing and a second portion extended from the casing. The socket includes a casing and two conductive elements. The casing includes a slot defined therein. The conductive elements are disposed in the casing so that the conductive elements are isolated from each other normally but connected to each other through the conductive card when the conductive card is inserted into the casing through the slot.

Other objectives, advantages and features of the present invention will be apparent from the following description referring to the attached drawings.

BRIEF DESCRIPTION OF DRAWINGS

The present invention will be described via detailed illustration of two embodiments referring to the drawings.

DETAILED DESCRIPTION OF EMBODIMENTS

Referring to FIGS. 1 through 6, a treadmill 92 is equipped with a security apparatus 100 according to a first embodiment of the present invention. The treadmill 92 includes a dashboard 921. The security apparatus 100 is disposed on the dashboard 921.

Figure 2:
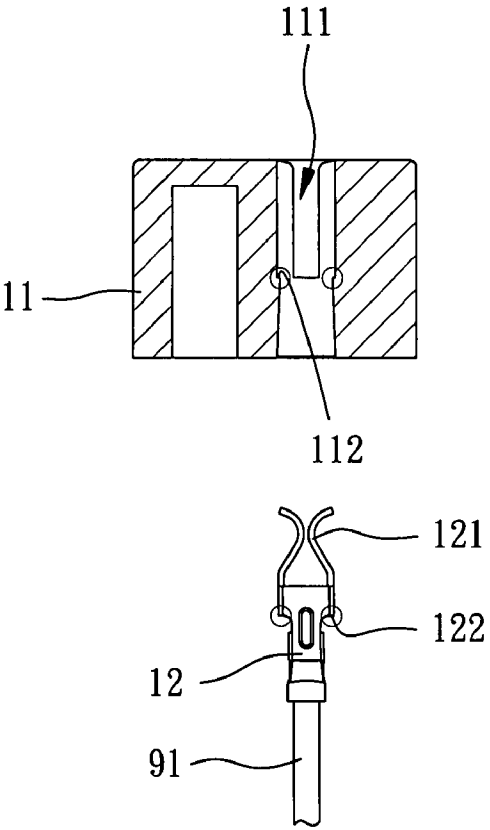
FIG. 2 is a cross-sectional view of the security apparatus of FIG. 1.
Figure 3:
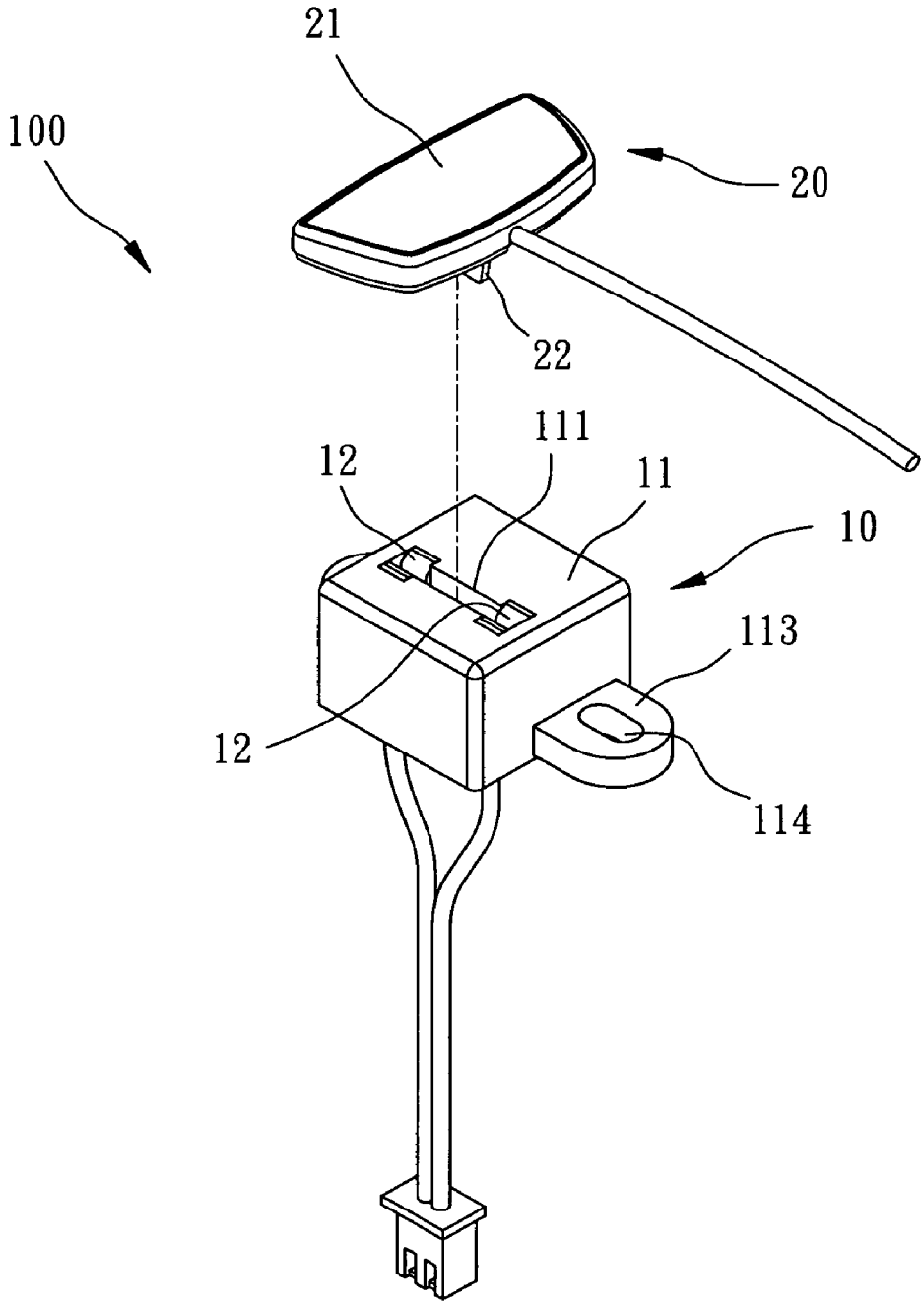
FIG. 3 is a partial view of the security apparatus shown in FIG. 2.
Figure 5:
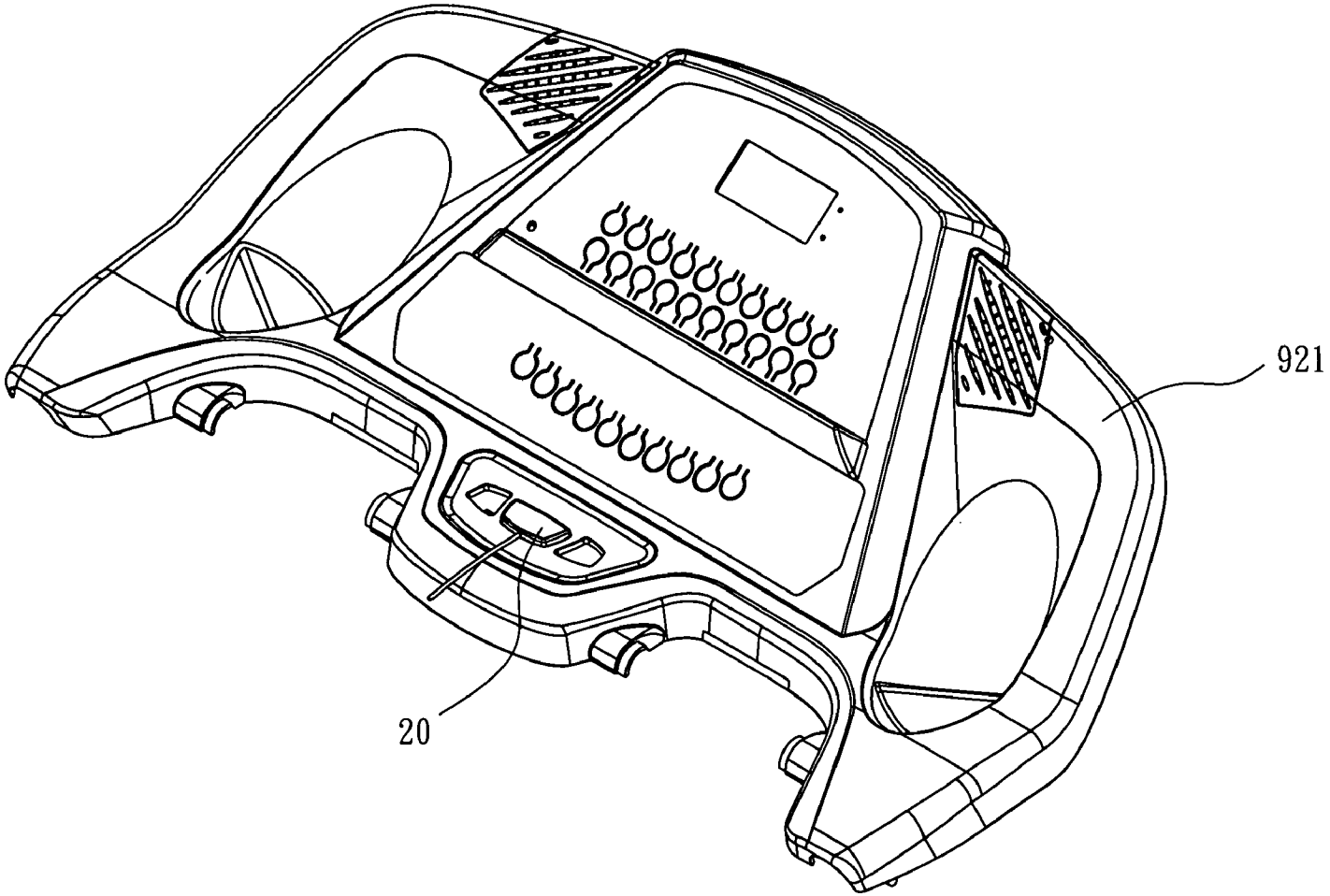
FIG. 5 is a perspective view of a treadmill-used dashboard equipped with the security apparatus shown in FIG. 4.

The security apparatus 100 includes a socket 10 and a plug 20. The socket 10 includes a casing 11 and two conductive clips 12 disposed in the casing 11. The casing 11 is made of an isolating material. The casing 11 includes a slot 111 defined in a ceiling and two lugs 113 formed on two opposite walls. Each of the lugs 113 includes a slot 114 defined therein. As best seen in FIG. 2, the slot 111 is defined between two opposite walls. A shoulder 112 is formed on each of the walls between which the slot 111 is defined. A screw can be driven into the dashboard 921 through the slots 114 so that the casing 11 is attached to the dashboard 921.

The conductive clips 12 are made of copper for example. Each of the conductive clips 12 includes two elastic prongs 121 each formed with a lower end 122. Access to the conductive clips 12 is allowed through the slot 111. Each of the conductive clips 12 is connected to a wire 91. The wires 91 are connected to a circuit that is used to drive a motor of the treadmill 92.

Figure 1:
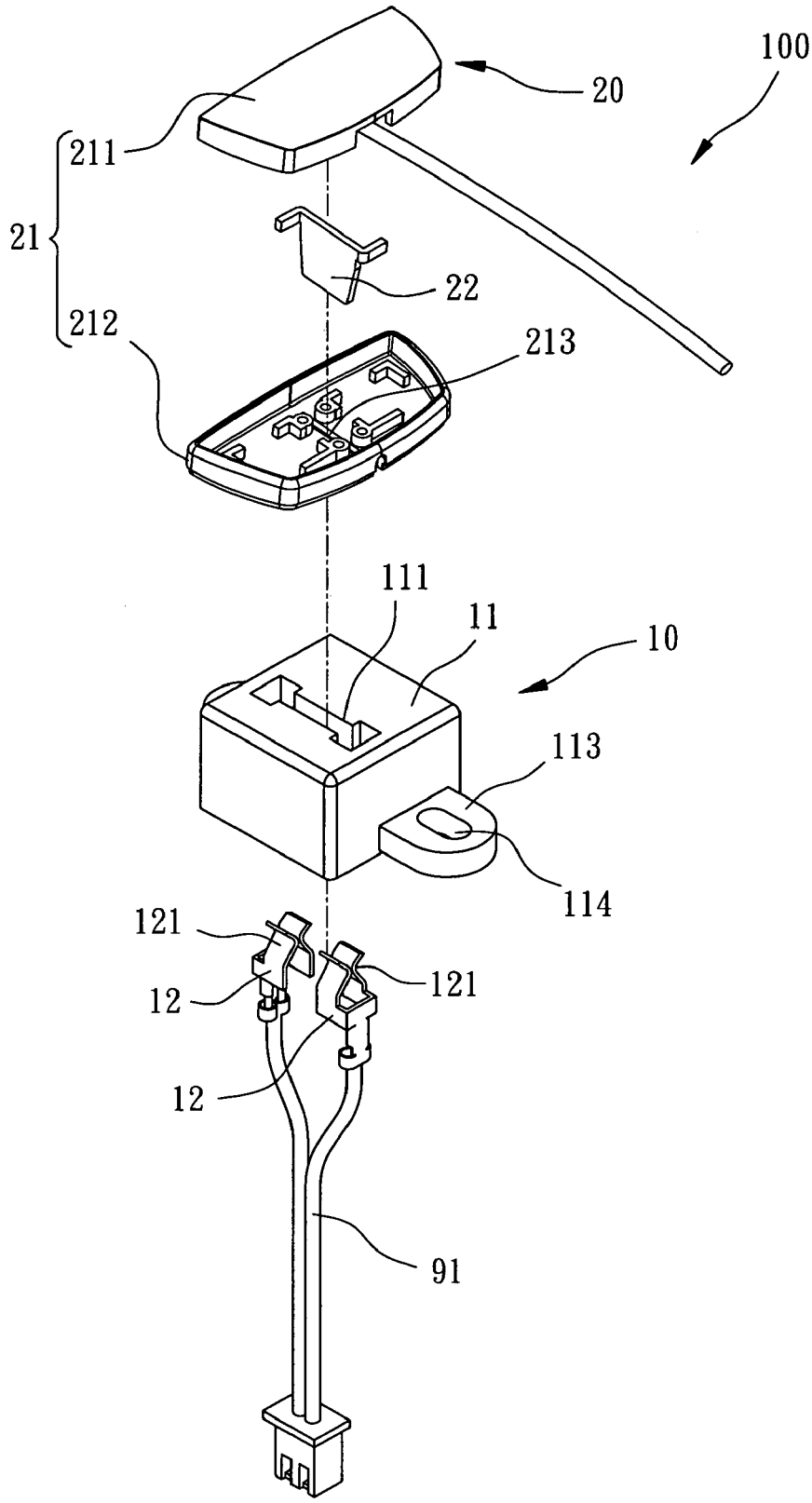
FIG. 1 is an exploded view of a security apparatus for a treadmill according to the first embodiment of the present invention.
Figure 4:
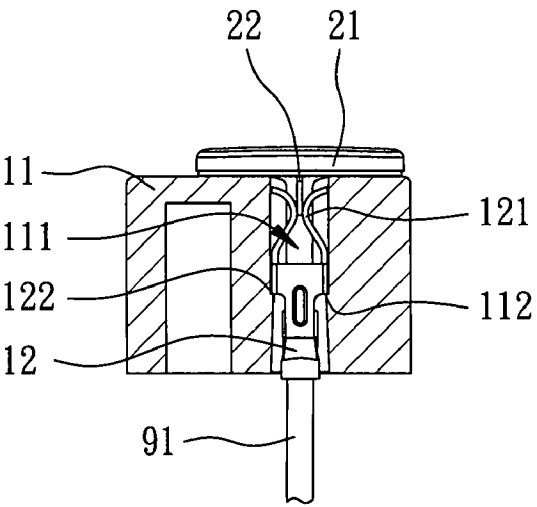
FIG. 4 is a perspective view of the security apparatus shown in FIG. 1.

Referring to FIG. 4, each of the conductive clips 12 is disposed in the slot 111. The lower end 122 of each of the elastic prongs 121 is supported on a related one of the shoulders 112.

The plug 20 includes a casing 21 and a conductive card 22 extended through the casing 21. The casing 21 is made of an isolating material. The casing 21 includes an upper shell 211 and a lower shell 212 attached to each other. The lower shell 212 includes a slot 213 defined therein.

The conductive card 22 includes a first portion in the casing 21 and a second portion outside the casing 21. The second portion of the conductive card 22 is extended through the slot 213.

Figure 6:
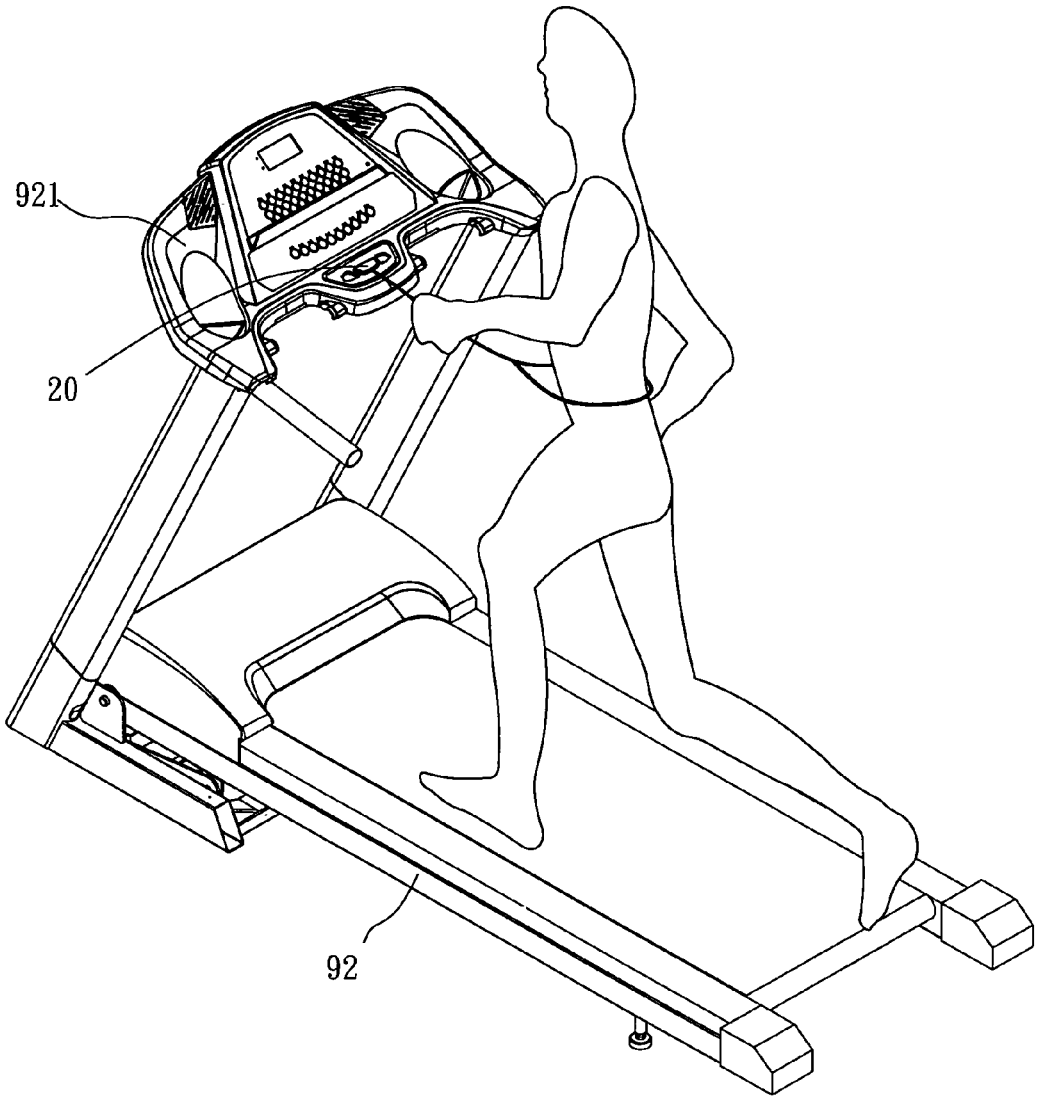
FIG. 6 is a perspective view of a person running on a treadmill equipped with the dashboard shown in FIG. 5.

Normally, the conductive clips 12 are isolated from each other so that the treadmill 92 cannot be actuated. To use the treadmill 92, the conductive card 22 is inserted into the slot 111 and brought into contact with the conductive clips 12 so that the treadmill 92 can be turned on. Referring to FIG. 6, the casing 21 is tied to a person running on the treadmill 92 through a rope. If the person falls, the conductive card 22 will be removed from the conductive clips 12, thus rendering the circuit open so that the treadmill 92 is stopped. Therefore, the person will not be cut with the treadmill 92.

Figure 7:
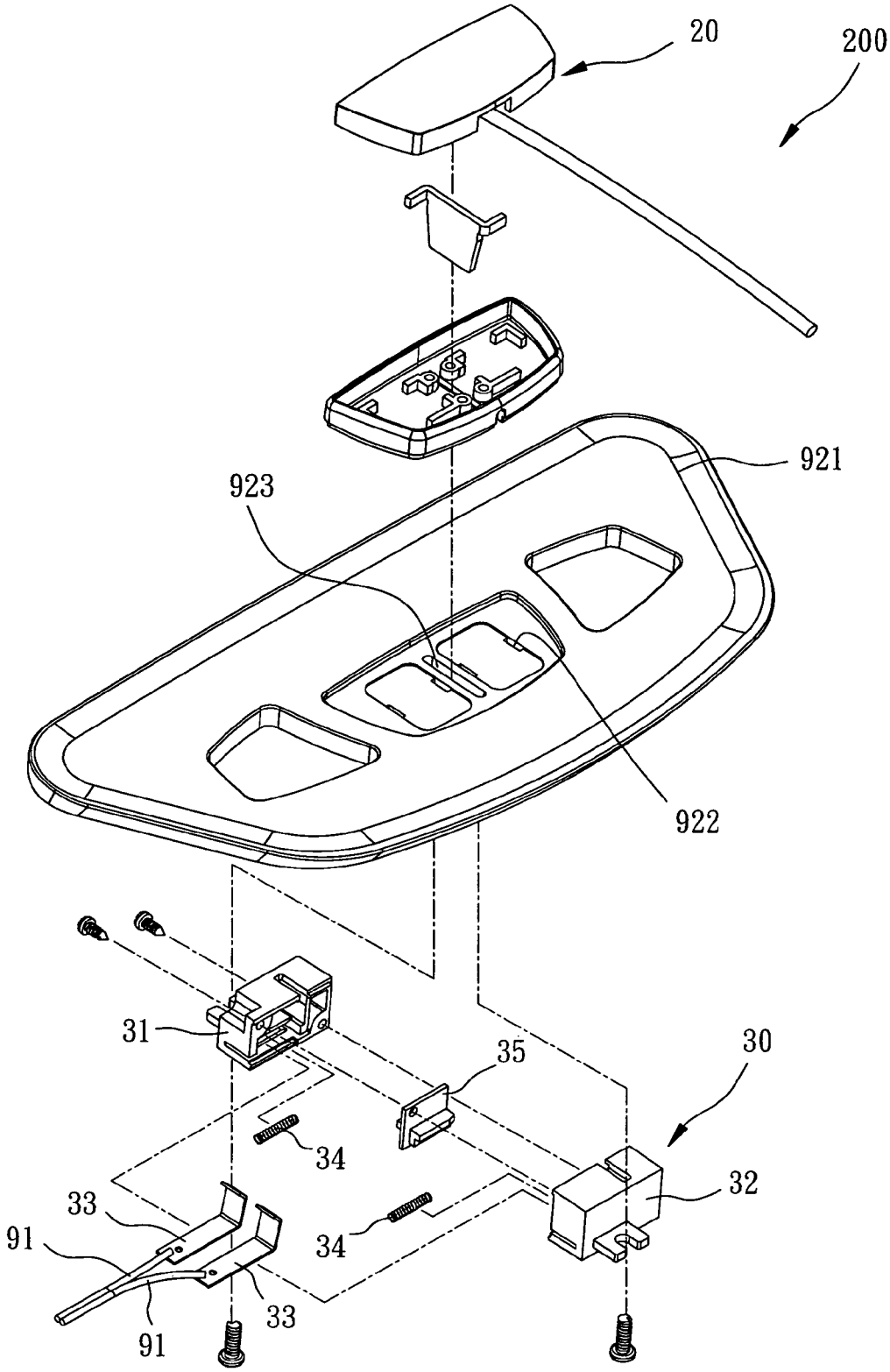
FIG. 7 is an exploded view of a security apparatus for a treadmill according to the second embodiment of the present invention.
Figure 8:
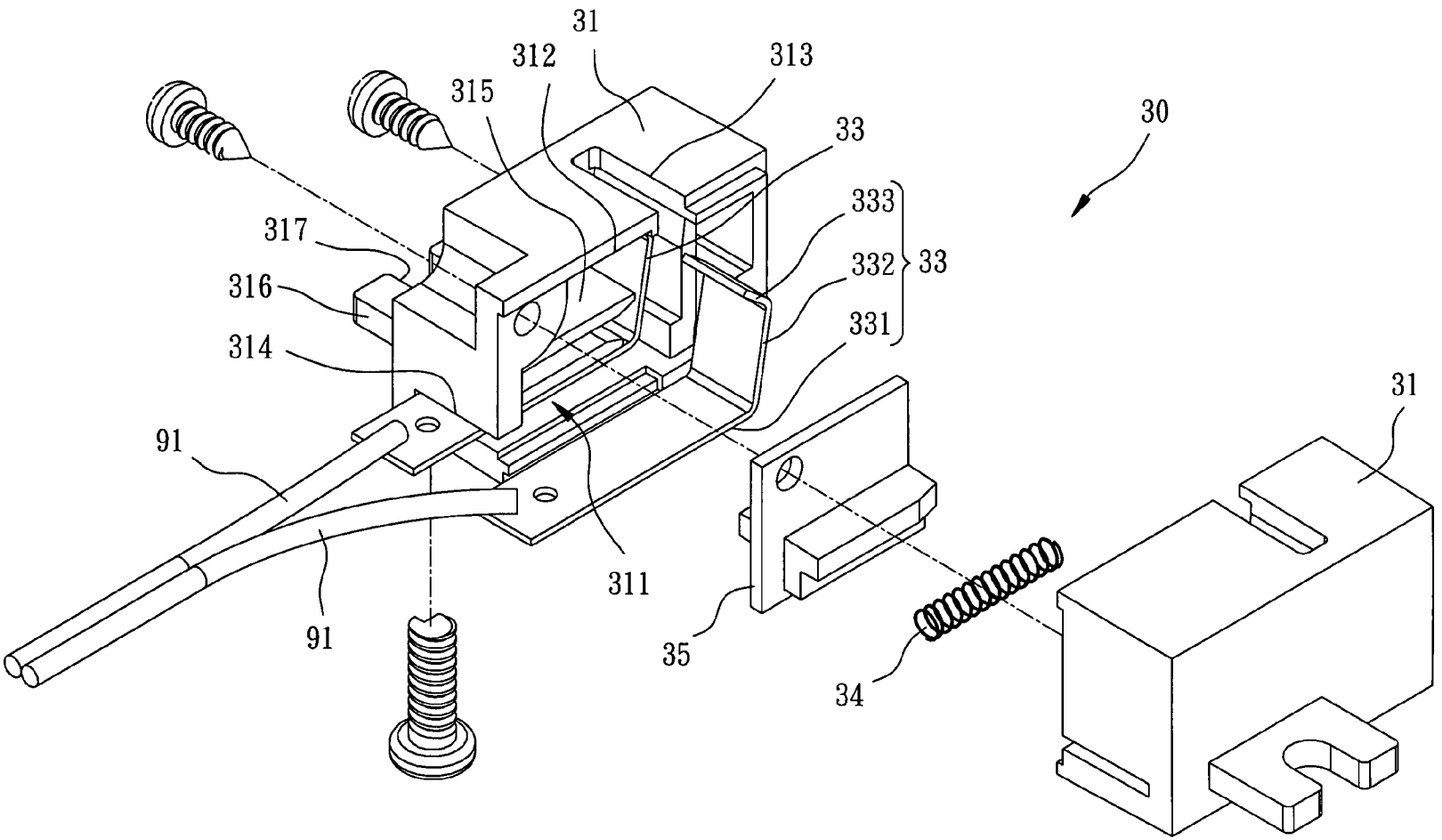
FIG. 8 is a partial view of the security apparatus shown in FIG. 7.
Figure 9:
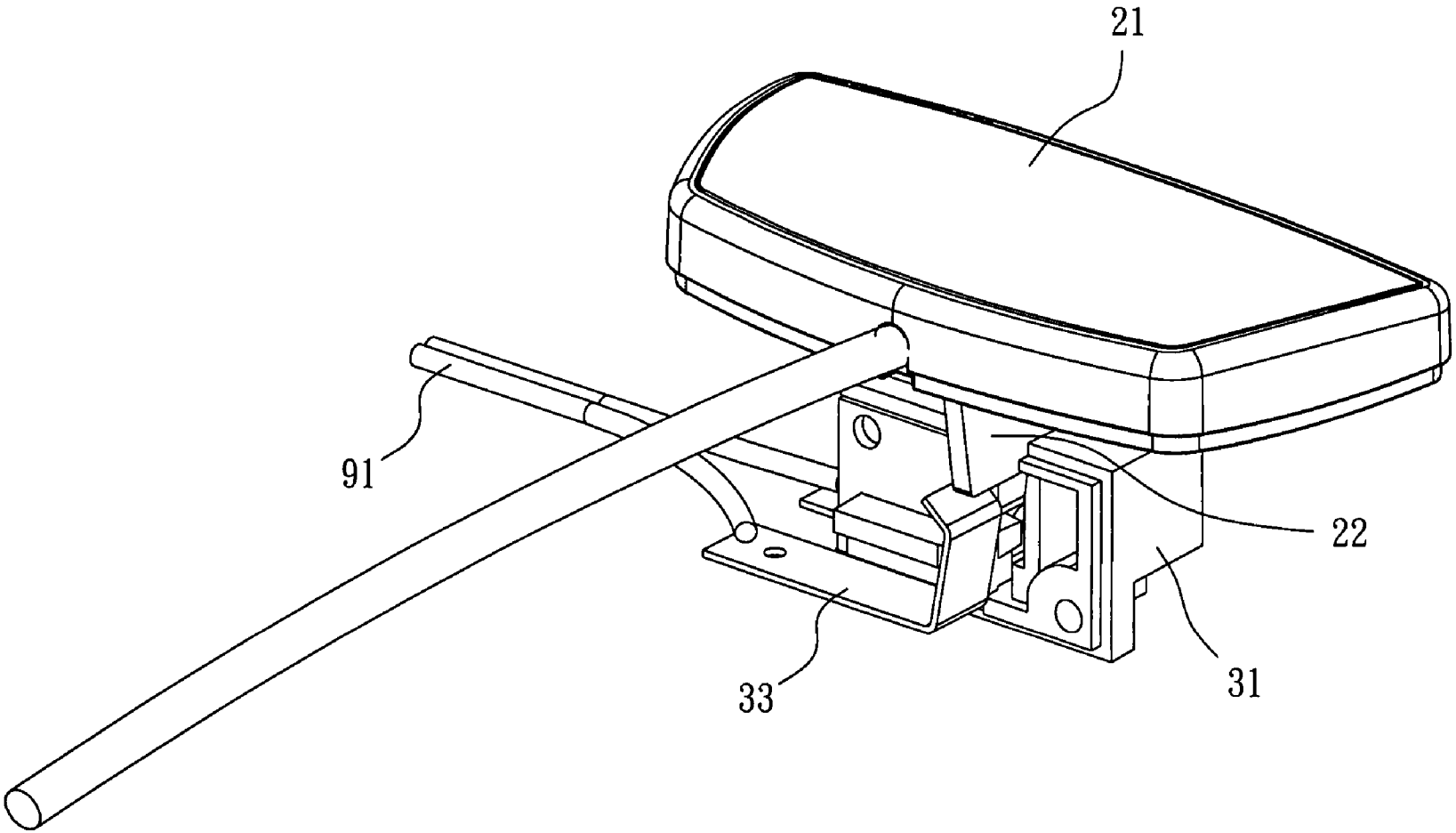
FIG. 9 is a perspective view of the security apparatus shown in FIG. 7.

Referring to FIGS. 7 through 9, a security apparatus 200 includes a socket 30 and a plug 20 according to a second embodiment of the present invention. The socket 30 includes a casing, two conductive strips 12, two elastic elements 34 and a partition 35. The casing is made of an isolating material. The casing includes two identical halves 31. Each of the halves 31 includes a space 311 defined therein, a slit 313 defined in a ceiling, a slit 314 defined in a wall, a plate 315 extended from an internal side and a lug 316 extended from an external side. The space 311 includes an opening 312. Both of the slits 313 and 314 are in communication with the space 31. The lug 316 includes a slit 317 defined therein.

The conductive strips 33 are made copper for example. Each of the conductive strips 33 includes a connective portion 311, a contact portion 312 extended from the connective portion 311 and a guiding portion 313 extended from the contact portion 312. The connective portion 311 of the each of the conductive strips 33 is located against the plate 315 of a related one of the halves 31, extended through the slit 314 of the related half 31 and connected to a wire 91. The contact portion 312 and the guiding portion 313 of each of the conductive strips 33 are disposed in the space 311 of a related one of the halves 31, near the slit 313. Access to the conductive strips 33 is allowed through the slits 313.

Each of the elastic elements 34 is disposed in the space 311 of a related one of the halves 31. Each of the elastic strips 34 includes an end in contact with the internal side of the related half 31 and another end in contact with the contact portion 332 of a related one of the conductive strips 33. That is, each of the elastic strips 34 is compressed between the internal side of the related half 31 and the contact portion 332 of the related conductive strip 33.

The partition 35 is located between the halves 31 so that the conductive strips 33 are isolated from each other.

The halves 31 are attached to each other after the conductive strips 33, the elastic elements 34 and the partition 35 are disposed in the halves 31. When the halves 31 are joined together, the slits 313 together become a slot through which the card 22 can be extended.

A screw can be driven into the dashboard 921 through the slits 317 so that the casing, which consists of the halves 31, is attached to the dashboard 921. The dashboard 921 includes slits 922 for receiving tabs extended from a lower face of the casing 21. The dashboard 921 includes a slot 923 in communication with the slot, which consists of the slits 313.

Normally, the conductive strips 33 are isolated from each other so that the treadmill 92 cannot be actuated. To use the treadmill 92, the conductive card 22 is inserted into the slot, which consists of the slits 313, and brought into contact with the conductive strips 33 so that the treadmill 92 can be turned on. The insertion of the conductive card 22 is facilitated with the guiding portions 333 of the conductive strips 33. The conductive card 22 is in form contact with the contact portions 332 of the conductive strips 33 because of inherent elasticity of the conductive strips 33.

The security apparatus of the present invention is durable and reliable because the conductive card is in contact with the conductive clips or strips that retain the elasticity and, therefore, the workability longer than the switch or rods discussed in the RELATED PRIOR ART.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A treadmill-used security apparatus, comprising:

a) a plug comprising:

i) a casing; and ii) a conductive card;

wherein said conductive card of said plug comprises:

i) a first portion; and ii) a second portion;

wherein said first portion of said conductive card of said plug is disposed in said casing of said plug;

wherein said second portion of said conductive card of said plug is extended from said casing of said plug;

wherein said casing of said plug comprises:

i) an upper shell; and ii) a lower shell;

wherein said lower shell of said casing of said plug is attached to said upper shell of said casing of said plug; and wherein said lower shell of said casing of said plug comprises a slot through which said conductive card of said plug is extended from said casing of said plug;

b) a socket comprising:

i) a casing; and ii) two conductive elements;

wherein said casing of said socket has a slot defined therein;

wherein said two conductive elements of said socket are disposed in said casing of said socket so as to allow said two conductive elements of said socket to be isolated from each other normally, but connected to each other directly through said conductive card of said plug when said conductive card of said plug is inserted into said casing of said socket, through said slot in said casing of said socket;

wherein each of said conductive elements of said socket is a conductive clip;

wherein each conductive clip comprises two elastic prongs;

wherein each elastic prong of each conductive clip is formed with a lower end;

wherein said casing of said socket comprise two shoulders;

wherein said two shoulders of said casing of said socket are respectively formed on two opposite sides of said slot in said casing of said socket;

wherein said two shoulders of said casing of said socket are for supporting said lower ends of said elastic prongs of said conductive clips; and wherein said two elastic prongs of one conductive clip are disposed collinearly with said two elastic prongs of the other conductive clip, respectively, and, said two shoulders of said casing of said socket are separate, distinct, and spaced-apart from each other, and said conductive card directly connects said two conductive clips to each other, so as allow said slot in said casing of said socket to be only one continuous slot and said conductive card of said plug to be only one continuous conductive card.

2. The treadmill-used security apparatus according to claim 1, wherein said casing of said socket comprises two lugs each comprising a slot defined therein so that a fastener can be driven into a dashboard of a treadmill through the slot of each of the lugs.

* * * * *